United States Patent [19]

Garland

[11] 4,151,724

[45] May 1, 1979

[54] PRESSURIZED REFRIGERANT FEED WITH RECIRCULATION FOR COMPOUND COMPRESSION REFRIGERATION SYSTEMS

[75] Inventor: Milton W. Garland, Waynesboro, Pa.

[73] Assignee: Frick Company, Waynesboro, Pa.

[21] Appl. No.: 805,938

[22] Filed: Jun. 13, 1977

[51] Int. Cl.[2] ..... F25B 7/00; F25B 41/00

[52] U.S. Cl. ..... 62/175; 62/54; 62/510; 62/513

[58] Field of Search ..... 62/113, 513, 509, 510, 62/175, 54

[56] References Cited

U.S. PATENT DOCUMENTS

| | | | |
|---|---|---|---|
| 1,106,287 | 8/1914 | Doelling | 62/513 X |
| 2,024,323 | 12/1935 | Wyld | 62/510 |
| 2,499,404 | 3/1950 | Marsh | 62/54 X |
| 2,553,623 | 5/1951 | Zumbro | 62/113 |
| 2,589,859 | 3/1952 | Phillips | 62/509 X |
| 2,677,944 | 5/1954 | Ruff | 62/510 X |
| 2,693,683 | 11/1954 | Toothman | 62/509 X |
| 2,717,765 | 9/1955 | Lawler, Jr. | 62/510 |
| 2,794,322 | 6/1957 | Etherington | 62/513 X |
| 2,794,328 | 6/1957 | Herrick | 62/513 X |
| 2,841,962 | 7/1958 | Richards | 62/174 |
| 2,867,094 | 1/1959 | Herrick | 62/513 X |
| 2,966,043 | 12/1960 | Ross | 62/174 |
| 3,150,498 | 9/1964 | Blake | 62/175 X |
| 3,184,926 | 5/1965 | Blake | 62/175 X |
| 3,214,932 | 11/1965 | Grant | 62/509 X |
| 3,427,819 | 2/1969 | Seghetti | 62/509 X |
| 3,763,901 | 10/1973 | Viland | 62/54 X |
| 3,797,265 | 3/1974 | Garland | 62/174 |
| 3,919,859 | 11/1975 | Ross | 62/503 |
| 4,059,968 | 11/1977 | Ross | 62/510 X |

FOREIGN PATENT DOCUMENTS

| | | | |
|---|---|---|---|
| 598372 | 5/1960 | Canada | 62/509 |
| 823143 | 11/1951 | Fed. Rep. of Germany | 62/513 |

*Primary Examiner*—Leslie Braun
*Attorney, Agent, or Firm*—Dowell & Dowell

[57] ABSTRACT

A two-stage refrigeration system has a gas-liquid intercooler which subcools liquid refrigerant passing from the feed tank to the evaporators. The feed tank is maintained at the desired pressure adequate for supplying the evaporators and receives return liquid from a separating system which is pressurized from the receiver. In a modification the system may be operated as a single stage or as a compound system.

12 Claims, 4 Drawing Figures

PRESSURIZED REFRIGERANT FEED WITH RECIRCULATION FOR COMPOUND COMPRESSION REFRIGERATION SYSTEMS

BACKGROUND OF THE INVENTION

1. Field of the Invention

This invention relates to refrigeration and more particularly to a system in which the advantages of a gas-liquid intercooler are provided with the ability to maintain the desired pressure for insuring adequate flow to the evaporators and in which a high level of safety protection to the compressor is provided.

2. Description of the Prior Art

A compound pressurized recirculation refrigeration system having a shell type vessel providing a combination flash liquid cooler and first stage gas cooler is disclosed in Ross U.S. Pat. No. 3,919,859. However, in such system no subcooling of the liquid for delivery purposes is provided. Thus, in this patent the liquid supplied to the evaporator is at the saturation temperature and therefore a further pressure drop in the line to the evaporator will result in the production of undesired flash gas at the control of the evaporator. Further, the liquid being delivered to the evaporator through line 15 is at an intermediate pressure in the compound system and thus there would not be a pressure difference on the liquid adequate for delivery thereof to high stage evaporators.

Garland U.S. Pat. No. 3,797,265 discloses a single stage system providing a pressurized refrigerant feed with recirculation.

The use of gas-liquid intercoolers has been known as, for example, disclosed in Zumbro U.S. Pat. No. 2,553,623.

Ross U.S. Pat. No. 2,966,043 discloses the flowing of liquid refrigerant directly into a suction line accumulator tank 24 which is in heat exchange relationship with a coil carrying liquid to high temperature evaporators. Liquid from the high temperature accumulator passes into a coil in heat exchange relationship in a low temperature accumulator 36. In Ross, both the high and low temperature accumulators maintain a liquid level in order to function as heat exchangers. Thus, each of the accumulators in Ross also function as the return liquid separator from its respective evaporator. In Ross the liquid feed to the low temperature evaporators is at an intermediate pressure instead of at a higher pressure. Furthermore, the liquid level in the high temperature accumulator 24 of Ross is fixed only when the tank 41 is not transferring. During such transfer, liquid level in the accumulator 24 increases.

In Ross U.S. Pat. No. 2,966,043 the liquid used for the purpose of cooling in accumulator 24, FIG. 1, is obtained from the second or low pressure receiver 30; in FIG. 2 from the receiver 68; in FIG. 3 from the receiver 115. FIG. 4 of Ross U.S. Pat. No. 2,966,043 discloses a single stage operation which uses a pilot receiver and a coil for liquid cooling in the return separator.

Other U.S. Pat. Nos. illustrating the prior art include Richard 2,841,962; Blake 3,150,498; and Blake 3,184,926.

SUMMARY OF THE INVENTION

The present invention is embodied in a simplified system providing for the efficient delivery of refrigerant at the desired pressure to both high and low temperature evaporators, in which the delivery pressure is adjustable and not limited by conditions in the high pressure suction portion of the system. Furthermore, the liquid for delivery to the evaporators is subcooled and at a pressure which will avoid the possibility of flash cooling in the line to the evaporators. The system provides a high degree of safety protection to the compressors against the possibility of liquid in the suction line.

DESCRIPTION OF THE PREFERRED EMBODIMENT

Figure 1:
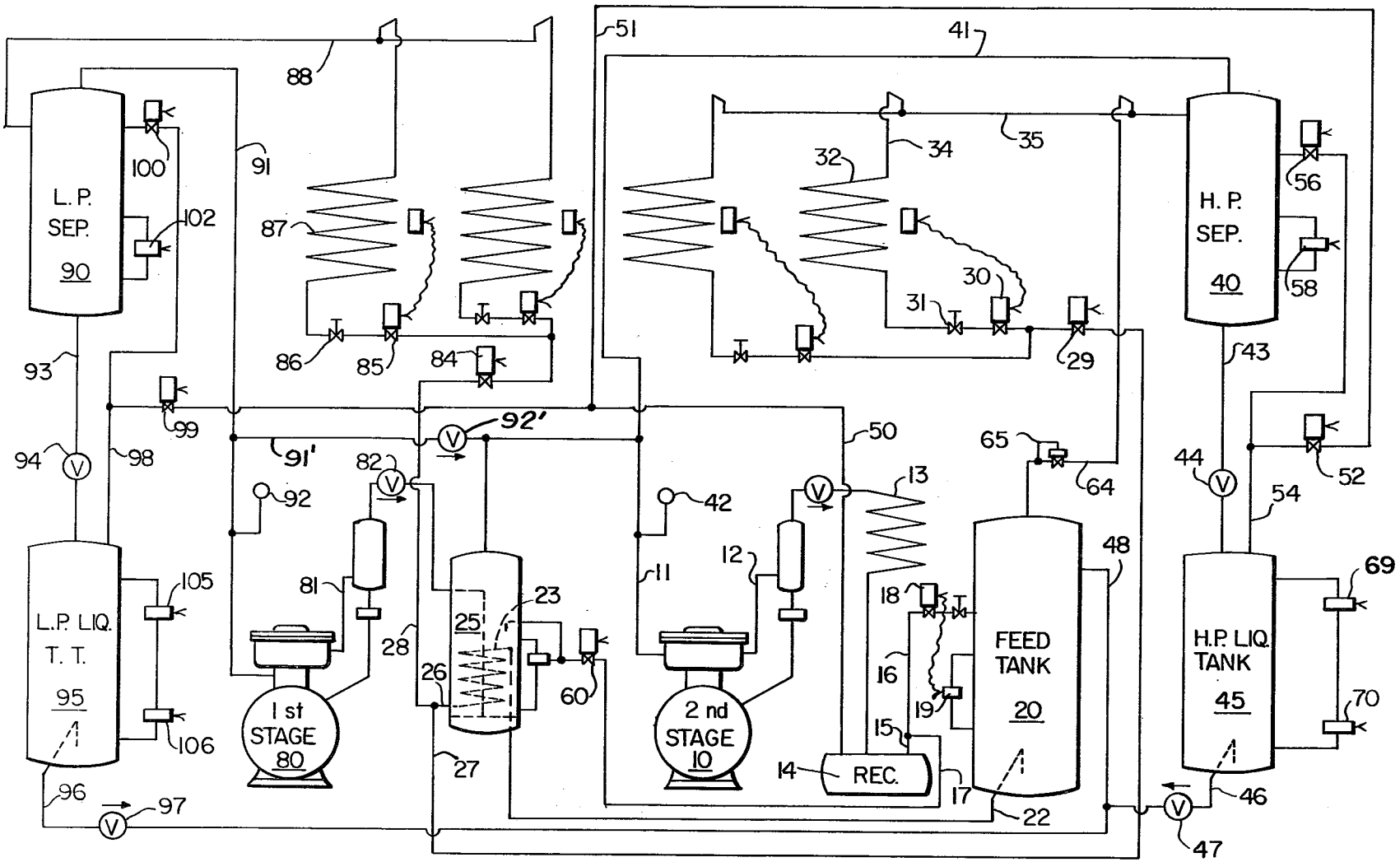
FIG. 1 is a schematic view of a preferred embodiment of the invention which may operate either as a compound or as a single high stage system.

With further reference to the drawings, and particularly FIG. 1, the system illustrated may be operated as a single stage or with a booster compressor for compound operation.

Referring first to single stage operation, compressor 10 has a suction line 11 and discharge line 12, condenser 13 and receiver 14. Receiver 14 feeds liquid through line 15 to lines 16 and 17.

Line 16 is connected through solenoid-operated valve 18 under the control of float feed switch 19 to feed tank 20. Feed tank 20 has a liquid discharge line 22 connected to coil 23 within gas-liquid intercooler 25. The outlet 26 of coil 23 has branch lines 27 and 28. Line 27 is connected through high stage liquid solenoid valve 29, room thermostat control valve 30 and expansion valve 31 to evaporator 32.

From evaporator 32, the refrigerant passes through lines 34 and 35 to the separator tank 40, otherwise described as the high pressure separator. High pressure separator 40 has a refrigerant vapor return line 41 connected to the suction line 11 which is provided with a high suction pressure limiting switch 42. The separator has a liquid return line 43 connected through check valve 44 to a liquid transfer tank 45, otherwise described as the high pressure liquid transfer tank. Liquid from tank 45 discharges through line 46 having check valve 47 into return line 48 to the feed tank 20.

In order to pressurize transfer tank 45 to cause the liquid to be transferred to the feed tank 20, a vapor pressure line 50 from receiver 14 is connected to branch line 51 through solenoid control valve 52 to line 54 into tank 45. Line 54 is an equalizing line connected through equalizing solenoid valve 56 to tank 40, valve 56 being closed during pressurizing of tank 45. The level in tank 40 is communicated to high level safety switch 58, as will be described later.

In order to cool gas-liquid intercooler 25, liquid refrigerant passes from the receiver 14 through line 17 through a feed solenoid 60 into the tank 25 where it is vaporized, the vapor passing out through line 11.

In order to maintain the desired pressure range in the feed tank 20, a pressure regulating valve 65 is positioned in a line 64 which connects the feed tank 20 to the evaporator line 35 that leads to the high pressure separator 40, the pressure in tank 20 always being higher than the pressure in separator 40.

The high pressure liquid transfer tank has upper and lower level control switches 69 and 70, whose operation will be described later.

The foregoing describes a system which may operate as a single stage with the components arranged as described. The system also has a booster stage connected thereto for compound operation. The booster stage includes a compressor 80, having a discharge line 81, which feeds through check valve 82 into the gas-liquid intercooler 25. As previously described, the refrigerant gas in intercooler 25 passes out into the suction line 11 of the high stage compressor 10.

Liquid refrigerant for the lower stage is supplied from the feed tank 20, coil 23 within the gas-liquid intercooler 25, outlet 26 and line 28 through solenoid control valve 84, room thermostat control valve 85, and expansion valve 86 to evaporator 87. From the evaporator 87, the refrigerant passes through line 88 into separator 90. Separator 90 is connected by suction line 91 having a high suction pressure limit switch 92 to compressor 80. Also, suction line 91 is connected to suction line 11 by a line 91' having a check valve 92'. Liquid from separator 90 passes through line 93 having check valve 94 into liquid transfer tank 95. From liquid transfer tank 95, liquid passes through line 96 having check valve 97 into line 48 to the feed tank 20. Tank 95, which may be described as the low pressure transfer tank, is pressurized at the appropriate time through line 98 having solenoid switch 99 and connected to pressure line 50 from receiver 14. No appreciable liquid level is maintained in either separator 40 or 90.

Line 98 is connected through solenoid control equalizing switch 100 to the upper portion of separator tank 90. A safety switch 102 is connected to separator tank 90 in an arrangement which will be described later. Liquid transfer tank 95 has upper and lower switch controls 105 and 106 for purposes which will be described later.

Figure 3:
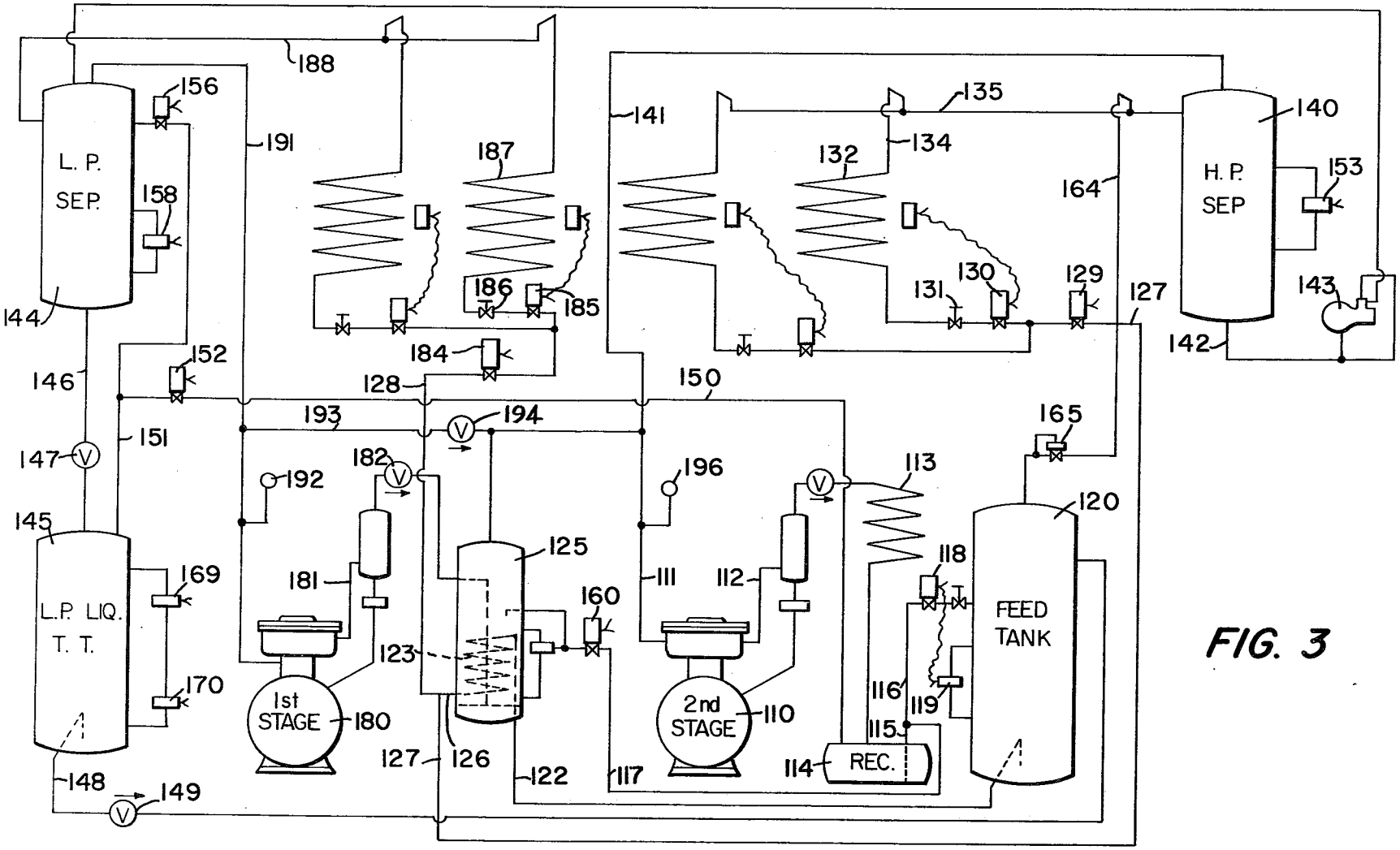
FIG. 3 is a schematic view of a modification in which the system operates as a compound system or a single high stage system.

The system illustrated in FIG. 3 may be compared to that in FIG. 1. The differences include the following. Although FIG. 1 and FIG. 3 each may be operated as a single high stage or as a compound system, FIG. 1 has two liquid transfer tanks, whereas FIG. 3, as will be described, has only one. In FIG. 3 a float expansion valve from the high pressure separator feeds liquid to the low pressure separator.

With further reference to the system of FIG. 3, the second or high stage compressor 110 has a suction line 111 and discharges through line 112 to evaporative condenser 113 into receiver 114. The receiver 114 feeds liquid through line 115 to branch lines 116 and 117.

Line 116 is connected through solenoid operated feed switch 118 under the control of float switch 119 to feed tank 120.

Feed tank 120 has a liquid discharge line 122 connected to coil 123 within gas-liquid intercooler 125. The outlet 126 of coil 123 has branch lines 127 and 128. Line 127 is connected through line stage liquid solenoid valve 129, room thermostat control 130 and expansion valve 131 to evaporator 132.

From evaporator 132 the refrigerant passes through lines 134 and 135 to the separator tank 140, otherwise described as the high pressure separator.

The high pressure separator 140 has a refrigerant vapor return line 141 connected to the suction line 111 of compressor 110 and a liquid return line 142 connected through modulating float expansion valve 143, which passes liquid only, to low pressure separator 144.

The low pressure separator has its liquid line 146 connected through check valve 147 to liquid transfer tank 145, otherwise known as the low pressure liquid transfer tank.

Liquid from transfer tank 145 flows by pressure difference through line 148 through check valve 149 into the feed tank 120. No appreciable liquid level is maintained in either separator 140 or 144.

In order to pressurize transfer tank 145 to cause the liquid to be transferred to the feed tank 120, a vapor pressure line 150 from receiver 114 is connected to branch line 151 through solenoid control valve 152 into tank 145. Line 151 is an equalizing line connected through equalizing solenoid valve 156 to tank 144, valve 156 being closed during pressurizing of tank 145.

By suitable control means, to be described later, the low pressure separator 144 with its connecting transfer tank 145 serve to collect and transfer liquid from the high pressure separator during single high stage operation.

The desired pressure range in the feed tank 120 is regulated by pressure regulating valve 165 in line 164 between the upper portion of tank 120 with line 135.

Tank 144 has a liquid level responsive safety switch 158 whose operation will be described later. Tank 140 has a similar level responsive safety switch 153.

The low pressure liquid transfer tank has upper and lower level control switches 169 and 170 whose purpose will be described later.

Booster compressor 180 has a discharge line 181 which feeds through check valve 182 into the gas-liquid intercooler 125. Refrigerant gas in the intercooler passes out into the suction line 111 of the high stage compressor 110.

Liquid refrigerant for the lower stage is supplied from the feed tank 120, coil 123 within the gas-liquid intercooler, line 126 and line 128 through solenoid control valve 184, thermostat control valve 185, and expansion valve 186 to evaporator 187. From the evaporator 187 the refrigerant passes through line 188 into separator 144.

Separator 144 is connected at its upper level to the booster compressor 180 by suction line 191 which has a high suction pressure limiting switch 192. Line 193 having check valve 194 connects suction line 191 of compressor 180 to suction line 111 of compressor 110, compressor 110 having a high suction pressure limiting switch 196.

Figure 2:
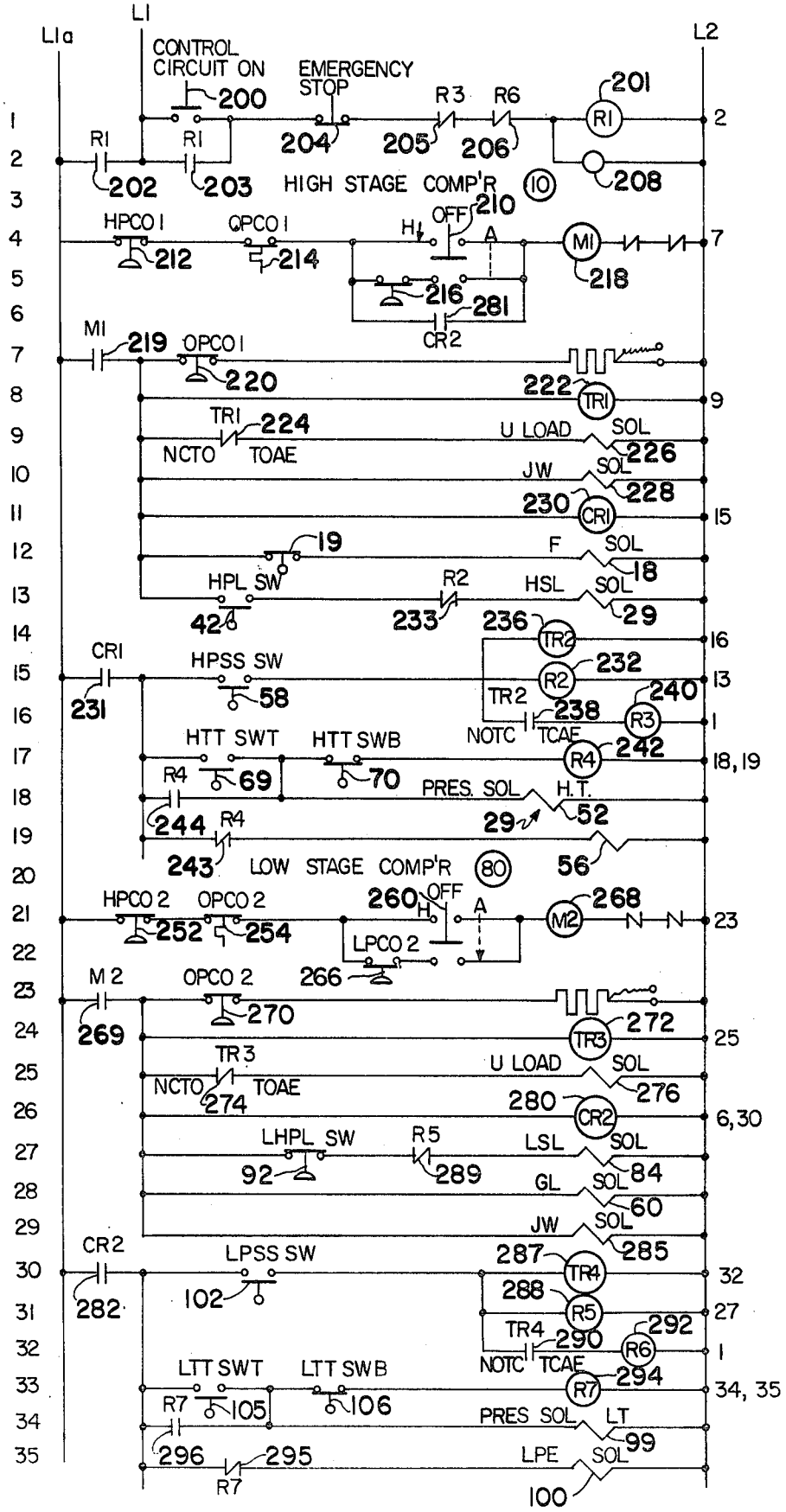
FIG. 2 is a simplified wiring diagram of the electrical control circuit of FIG. 1.

The Electrical Control Circuit, FIG. 2

Reference is made to FIG. 2, a simplified diagram of the electrical control circuit for the apparatus of FIG. 1, and particularly to the sequential numbering of the lines along the left border of the diagram. Power lines L1 and L2 are indicated as leading in at the top of the diagram. In order to energize the main line L1a pushbutton 200 in line 1 is moved to the "on" position, the pushbutton being spring-biased toward open position. The momentary closing of pushbutton 200 energizes R1 relay 201 which closes contacts 202 and 203 in line 2. This bypasses pushbutton switch 200 and keeps relay 201 energized through the contacts of emergency stop 204, normally closed R3 relay contacts 205 and normally closed R6 contacts 206, line 1. Line L1a remains energized so long as R1 relay 201 is energized.

Manual pushing of emergency stop 204 opens a circuit to R1 relay 201 thereby instantly de-energizing line L1a. Indicator light 208, line 2, bridging R1 relay 201 is lit when the latter is energized.

Operation of the high-stage compressor 10 is usually initiated by moving H-OFF-A switch 210, line 4, into the automatic position, thereby closing the circuit across its contacts in line 5. The upper contacts of this switch in line 4 permit manual control for service requirements. HPCO1 in line 4 indicates a safety cutout switch 212 responsive to predetermined high pressure in the compressor 10. OPCO1 in line 4 indicates a safety cutout switch 214 responsive to a predetermined low oil pressure in the compressor. In line 5 LPCO1 indicates an automatic stop and start switch 216 from low suction pressure and high suction pressure, respectively.

In line 4 the compressor motor starter has a pull up coil M1, 218 which operates to close M1 contacts 219 in line 7, thereby closing the circuit to the lines 7 through 13 from L1a. Line 7 also has contacts 220 of OPCO1 associated with low pressure cutout switch 214 in line 4.

Line 8 has a timing relay 222, identified as TR1, which, after a predetermined interval, opens the normally closed contacts 224 in line 9. Line 9 also has solenoid 226 which maintains the compressor unloaded during starting. Usually after a predetermined interval, say 30 seconds, contacts 224 open to permit the compressor to start pumping. In line 10 jacket water solenoid 228 is indicated.

In line 11 CR1 control relay 230 operates to close contacts 231 in line 15, thereby energizing the liquid transfer system. Line 15 includes the high safety float switch 58 associated with high pressure separator tank 40. If the liquid level in tank 40 is sufficiently high to close the contacts of switch 58, then R2 relay 232 in line 15 is energized, thereby opening its normally closed R2 contacts 233 in line 13, and thus closing or deenergizing the high stage solenoid switch 29 also in line 13 and stopping flow to evaporator 32.

Line 12 has the float switch 19 for the feed tank 20 and its solenoid valve 18.

Line 13 also includes the high pressure limit switch 42 on the suction line 11 of high stage compressor 10. When the suction pressure is reduced to a predetermined level, switch 42 closes to permit energization of solenoid 29 which controls a flow to evaporators 32.

In line 14 TR2 timing relay 236 provides additional safety protection. It becomes energized whenever the high safety float switch 58 associated with tank 40 is closed. After a preset time, its TR2 contacts 238 in line 16 close, thereby energizing R3 relay 240. Energizing the latter opens the normally closed contacts 205 in line 1, thereby shutting down the system.

Since the safety switch 58 is normally open, the normal operation of the remaining controls in lines 15 to 19 is as follows.

Referring first to the high pressure liquid transfer tank 45, the high and low float switches 69, 70 are indicated in line 17 with R4 relay 242 which has normally closed R4 contacts 243 in line 19, and normally open R4 contacts 244 in line 18, line 19 also having the solenoid control for valve 56 of tank 40. Thus, when the liquid level in tank 45 closes contacts 69, relay 242 is energized thereby closing R4 relay contacts 244 in line 18 and opening contacts 243 in line 19. The closing of contacts 244 in line 18 energizes the solenoid control for valve 52 thereby permitting high pressure vapor from line 51 to enter transfer tank 45 through line 54, and thereby force liquid in tank 45 to return to the feed tank 20. Simultaneously R4 contacts 243 in line 19 are open thereby de-energizing the contacts of solenoid valve 56 and thus closing the vent line from the transfer tank 45 to the separator tank 40.

Lines 21 to 29 relate to the control of the low stage compressor 80. In line 21 the HPCO2 high pressure cutoff 252 and OPCO2 oil pressure cutoff are normally closed, and with H-OFF-A switch 260 in the top position, the compressor would start under manual control. However, manual control is for purposes of servicing and normal running occurs with the switch in the bottom automatic position bridging the contacts in line 22. LPCO2 low pressure cutoff switch 266 in line 22 is a pressure responsive switch which closes at a predetermined high pressure to start the compressor and opens at a predetermined low pressure to stop the compressor.

M2 relay 268 in line 21 is the pull-up coil for the starter of compressor 80 and closes contacts 269 in line 23 when relay 268 is energized.

Also in line 23, OPCO2 oil pressure cutoff switch 270 is part of the oil pressure failure switch and breaks the circuit in line 23 when oil pressure reaches a predetermined level as the compressor starts.

Lines 24 and 25 illustrate unloading controls. Thus, in line 24 TR3 relay 272, when energized, opens its normally closed TR3 contacts 274 in line 25, thereby operating unloading solenoid 276 which may operate a conventional unloading mechanism.

In line 26 CR2 control relay 280 operates to close CR2 contacts 281 in line 6 and CR2 contacts 282 in line 30. The closing of contacts 281 will start the high stage compressor 10 if it is not already in operation. The closing of contacts 282 in line 30 will close the circuit from line L1a to the various lines 30-35, inclusive.

Referring to line 27, the LHP high suction pressure limit switch 92 in the suction line 91 to the compressor 80 can close the circuit to the LSL low stage liquid line feed solenoid 84 in the liquid line 28 to the low stage evaporators 87, until the compressor has reduced the suction pressure to the desired level. In line 28 the GL solenoid 60 in the feed line 17 to the gas liquid intercooler 25 is energized to permit liquid feed through that line.

Line 29 has a jacket water solenoid 285 to permit water flow through the jacket when the compressor 80 is in operation.

Referring to line 30 CR2 contacts 282 are closed by relay 280 as soon as the low stage compressor 80 starts. Normally the low pressure separator safety float switch 102, associated with tank 90, is open, but if the level in the separator 90 becomes too high, (as, for example, due to failure of controls in the low pressure liquid transfer tank 95) timing relay TR4 287 in line 30 and R5 relay 288 in line 31 will be energized. Energizing relay 288 breaks the R5 contacts 289 in line 27 to de-energize LSL low stage liquid line feed solenoid thus stopping liquid feed to the low stage evaporators. TR4 timer 287 in line 30 will, after a predetermined interval, close the normally open T4 contacts 290 in line 32, thus energizing R6 relay 292 which opens normally closed R6 contacts 206 in line 1, thus shutting down the system.

Referring first to the low pressure liquid transfer tank 95, the high and low float switches 105, 106 are indicated in line 33 with R7 relay 294 which has normally closed R7 contacts 295 in line 35, and normally open R7 contacts 296 in line 34, line 35 also having the LPE solenoid control for valve 100 of tank 90. Thus, when the liquid level in tank 95 closes contacts 105, R7 relay 294 is energized thereby closing R7 relay contacts 296 in line 34 and opening contacts 295 in line 35. The closing of contacts 296 in line 34 energizes the solenoid control for valve 99 thereby permitting high pressure vapor from receiver 14 and vapor line 50 to enter transfer tank 95 through line 98, thereby forcing liquid in tank 95 to return to the feed tank 20. Simultaneously R7 contacts 295 in line 35 are opened thereby de-energizing LPE solenoid valve 100 and thus closing the vent from the transfer tank 95 to separator tank 90.

Figure 4:
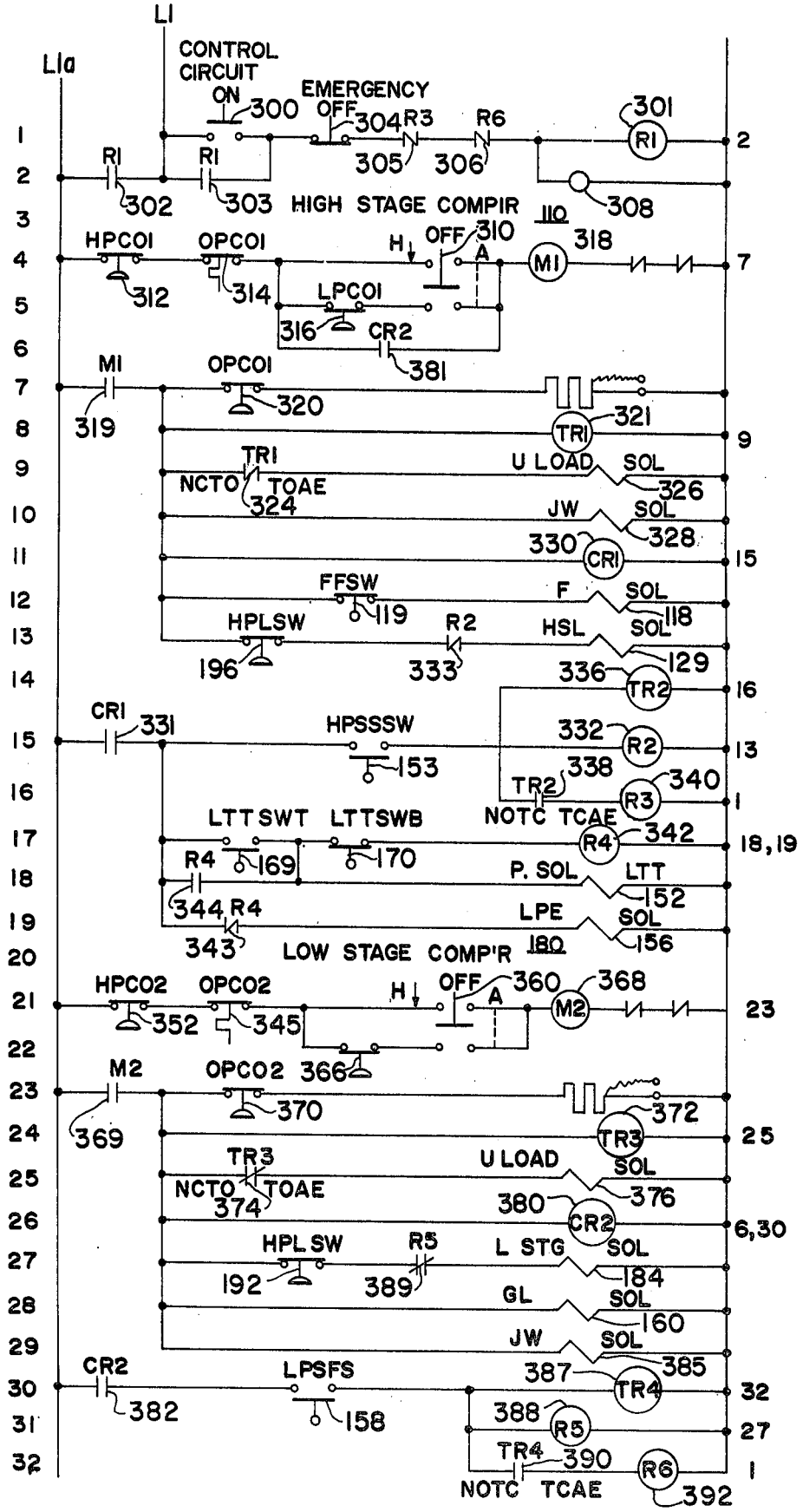
FIG. 4 is a simplified wiring diagram of the electrical control circuit of FIG. 3.

The Electrical Control Circuit, FIG. 4

Referring to FIG. 4, the illustrated electrical system is similar to that of FIG. 2, with differences which will become apparent. In FIG. 4, line 1 has control circuit pushbutton 300, emergency stop switch 304, normally closed R3 relay contacts 305, normally closed R6 relay contacts 306 and R1 relay 301, corresponding in function to the similarly described elements in line 1 of FIG. 2. Line 2 has R1 contacts 302 and 303, and indicator light 308.

The high stage compressor 110, FIG. 3, is operated by elements similar to those which operate high stage compressor 10 as described in connection with FIGS. 1 and 2. Thus line 4 has high pressure safety cutout switch 312, low oil pressure cutout switch 314, upper manual operation contacts of H-OFF-A switch 310 and starter pull-up coil 318. Line 5 has LPCO1 stop and start switch 316 and the lower automatic operation contacts for switch 310. Line 6 has CR2 contacts 381.

Line 7 has M1 relay contacts 319 and low pressure cutout switch contacts 320. Line 8 has TR1 timing relay 321. Line 9 has TR1 contacts 324 and compressor unloading solenoid 326. Line 10 has jacket water solenoid 328. Line 11 has CR1 control relay 330. Line 12 has float switch 119 for the feed tank 120 and its solenoid valve 118.

Line 13 has the high pressure limit switch 196 on the suction line 111 of high stage compressor 110. When the suction pressure is reduced to a predetermined level, switch 196 closes to permit energization of solenoid 129 in the liquid line 127 (FIG. 3), through the normally closed R2 relay contacts 333.

Line 14 has TR2 relay 336. Line 15 has CR1 relay contacts 331, float safety switch 152 associated with high pressure separator tank 140 and R2 relay 332. Line 16 has TR2 relay contacts 338 and R3 relay 340.

Note that line 15 CR1 relay contacts 331 comes from the high stage. This keeps the operation of the low stage transfer system available when only the single high stage is in operation.

Normal operation of the system assumes that the float expansion valve 143, FIG. 3, associated with the high pressure separator tank 140, will maintain this tank free of liquid accumulation above a predetermined level. However, failure of the float expansion valve 143 to function properly could close the contacts of safety float switch 153 and cause R2 relay 332 to become energized, thus opening electrical line 13 to the solenoid 129. This closes the valve and stops all liquid feed to the high side evaporators 132 until the malfunction of the float expansion valve is corrected. It thus prevents any possible damage to the high stage compressor 110 which could result from an excess of liquid in tank 140.

Line 17 has the high and low pressure transfer tank float switches 169 and 170, respectively, and R4 relay 342. Line 18 has R4 relay contacts 344 and the solenoid control for valve 152 which is in the vapor line 150 from the receiver 114. Line 19 has R4 relay contacts 343 and the solenoid control for valve 156 connected to the vent line at the top of the low pressure separator tank 144.

Referring to the controls for the low stage compressor 180, line 21 has the high pressure cutoff switch 352 and the oil pressure cutout switch 345. In the same line are the top manual operating contacts of the H-OFF-A switch 360 and M2 relay 368. Line 22 has the pressure-responsive switch 366 and the lower automatic operating contacts of switch 360.

Line 23 has M2 relay contacts 369 and pressure failure switch 370. Unloading controls are illustrated in lines 24 and 25. Line 24 has TR relay 372. Line 25 has normally closed TR3 contacts 374 and unloading solenoid 376. Line 26 has CR2 control relay 380.

Line 27 has high pressure limit switch 192 in the suction line to the compressor 180. Line 27 also has R5 relay contacts 389 and the low-stage liquid feed solenoid valve 184 in the liquid line 128 to the low-stage evaporator 187.

Line 28 gas solenoid 160 in the feed line 117 to the gas liquid intercooler 125. Line 29 has the jacket water solenoid 385.

Line 30 has CR 2 contacts 382, low pressure separator safety switch 158 and timing relay 387. Line 31 has R5 relay 388 and line 32 has normally open TR4 relay contacts 390 and R6 relay 392.

I claim:

1. In a refrigeration system having interconnected compressing, condensing, receiving, evaporating, separating, and suction means, the improvement comprising, liquid storage means connected to receive liquid from said receiving means, liquid transfer means connected to receive liquid from said separating means, said liquid transfer means connected to feed liquid to said liquid storage means, means for regulating the pressure of said liquid storage means up to that of said receiving means, means for applying pressure to said liquid transfer means to force liquid refrigerant therefrom into said liquid storage means, said liquid storage means connected to feed said evaporating means, said evaporating means connected to feed said separating means, said separating means also connected to feed only vaporized refrigerant to said compressing means, and means for subcooling said liquid from said liquid storage means before it feeds to said evaporating means, said subcooling means being fed with liquid from said receiving means and connected to feed vaporized refrigerant to the suction of said compressing means.

2. The invention in claim 1, and second compressing, evaporating, separating, and suction means, said second compressing means connected to deliver compressed refrigerant to said subcooling means, second liquid transfer means connected to said liquid storage means, means for applying pressure to said second liquid transfer means to force liquid refrigerant therefrom into said liquid storage means, said second evaporating means connected to said second separating means, said second separating means connected to said second liquid transfer means, and said liquid storage means connected to feed both said evaporating means at the pressure of said liquid storage means.

3. The invention of claim 2, and means responsive to an excess of a predetermined liquid level in the second separating means for stopping flow of liquid refrigerant from the liquid storage means to the second evaporating means.

4. The invention of claim 2, and means responsive to an excess of a predetermined liquid level for a predetermined interval of time in the second separating means for shutting down operation of the first and second compressing means.

5. The invention of claim 2, in which said means for applying pressure to said second liquid transfer means is a controlled connection for the passage of vapor from the receiving means to the liquid transfer means.

6. The invention of claim 1, and means for maintaining the pressure in said liquid storage tank at a predetermined level which is intermediate the pressure in the receiving and separating means.

7. The invention of claim 1, and means for equalizing the pressure in said separating means with the pressure in the liquid transfer means, whereby liquid from the separating means may flow by gravity into the transfer means.

8. The invention of claim 1, and means responsive to an excess of a predetermined liquid level in the separating means for stopping flow of liquid refrigerant from the liquid storage means to the evaporating means.

9. The invention of claim 1, and means responsive to an excess of a predetermined liquid level for a predetermined interval of time in the separating means for shutting down operation of the compressing means.

10. The invention of claim 1, in which said means for applying pressure to said liquid transfer means is a controlled connection for the passage of vapor from the receiving means to the liquid transfer means.

11. In a refrigeration system having interconnected first and second stage compressing means, condensing, receiving, first and second stage evaporating means, first and second stage separating means, and first and second stage suction means, the improvement comprising, liquid storage means connected to receive liquid from said receiving means, liquid transfer means connected to receive liquid from said first stage separating means, said liquid transfer means connected to feed liquid to said liquid storage means, float expansion valve means connected to feed liquid from said second stage separating means to said first stage separating means, means for applying pressure to said liquid transfer means to force liquid refrigerant therefrom into said liquid storage means, said liquid storage means connected to feed said first and second stage evaporating means, said evaporating means connected to feed said first and second stage separating means, said first and second separating means also connected to feed only vaporized refrigerant to said first and second stage compressing means, respectively, and means for subcooling said liquid from said liquid storage means before it feeds to said evaporating means, said subcooling means being fed with liquid from said receiving means and connected to feed vaporized refrigerant to the suction of said second stage compressing means.

12. The invention of claim 11, and means for equalizing the pressure in said first stage separating means with the pressure in said liquid transfer means, whereby liquid from said separating means may flow by gravity into the liquid transfer means.

* * * * *